US009662681B2

(12) United States Patent
Madar et al.

(10) Patent No.: US 9,662,681 B2
(45) Date of Patent: May 30, 2017

(54) POSTAL SORTING EQUIPMENT INCLUDING A FEED MAGAZINE WITH TWO SUPERPOSED DECKS

(71) Applicant: Solystic, Bagneux (FR)

(72) Inventors: Francois Madar, Bourg les Valence (FR); Arnaud Caron, Toulouse (FR)

(73) Assignee: SOLYSTIC, Bagneux (FR)

( * ) Notice: Subject to any disclaimer, the term of this patent is extended or adjusted under 35 U.S.C. 154(b) by 247 days.

(21) Appl. No.: 14/390,889

(22) PCT Filed: Jul. 10, 2014

(86) PCT No.: PCT/FR2014/051780

§ 371 (c)(1),
(2) Date: Oct. 6, 2014

(87) PCT Pub. No.: WO2015/040293

PCT Pub. Date: Mar. 26, 2015

(65) Prior Publication Data

US 2016/0256896 A1 Sep. 8, 2016

(30) Foreign Application Priority Data

Sep. 20, 2013 (FR) ..... 13 59057

(51) Int. Cl.
*B65B 69/00* (2006.01)
*B07C 1/02* (2006.01)
(Continued)

(52) U.S. Cl.
CPC ..... *B07C 1/025* (2013.01); *B65H 1/025* (2013.01); *B65H 1/30* (2013.01);
(Continued)

(58) Field of Classification Search
CPC B65G 2207/46; B01C 7/025; B65H 2801/78; B65H 2301/42254; B65H 1/025; B65H 2701/1916
(Continued)

(56) References Cited

U.S. PATENT DOCUMENTS 4,005,792 A * 2/1977 Schulman ..... B07C 1/025 414/416.09
5,054,992 A * 10/1991 Hognestad ..... B65G 65/00 198/867.08
(Continued)

FOREIGN PATENT DOCUMENTS

FR 2 288 562 A1 5/1976
WO 2013/093259 A1 6/2013

*Primary Examiner* — Michael McCullough
*Assistant Examiner* — Mark Hageman
(74) *Attorney, Agent, or Firm* — Ware, Fressola, Maguire & Barber LLP

(57) ABSTRACT

Postal sorting equipment comprises a sorting machine with an unstacking member (5) and a feed magazine (7). The equipment further comprises storage trays (4) for storing mailpieces (3) and for bringing them into the feed magazine. The magazine has a deck with a first deck portion (22) that is superposed above a second deck portion (23). Each tray (4) has a bottom (26) provided with a groove that is open to the front and to the top of the tray. The first deck portion and the groove of each tray are designed to fit together so that when a tray filled with mailpieces in a stack and on edge is standing on the second deck portion, the first deck portion comes to fit into the groove in the tray under the stack of mailpieces, thereby enabling the mailpieces to be unloaded automatically from the tray.

5 Claims, 7 Drawing Sheets

(51) Int. Cl.
*B65H 1/30* (2006.01)
*B65H 1/02* (2006.01)

(52) U.S. Cl.
CPC ..... *B65H 2301/42254* (2013.01); *B65H 2701/1916* (2013.01); *B65H 2801/78* (2013.01)

(58) Field of Classification Search
USPC ..... 414/331.01–331.04
See application file for complete search history.

(56) References Cited

U.S. PATENT DOCUMENTS

| | | | | |
|---|---|---|---|---|
| 5,713,713 | A | 2/1998 | Syde et al. | |
| 6,503,044 | B1 * | 1/2003 | Enenkel | B07C 1/02 414/403 |
| 6,575,306 | B1 * | 6/2003 | Schuster | B07C 1/025 209/706 |
| 7,766,171 | B2 * | 8/2010 | Wakamiya | B07C 3/02 209/584 |
| 8,020,701 | B2 * | 9/2011 | Berdelle-Hilge | B07C 3/008 206/425 |
| 8,172,498 | B2 | 5/2012 | Enenkel | |
| 2005/0077217 | A1 | 4/2005 | Hillerich et al. | |
| 2011/0061995 | A1 * | 3/2011 | Huff | B65G 47/52 198/463.3 |
| 2014/0205402 | A1 * | 7/2014 | Caron | B65H 1/025 414/373 |
| 2015/0273530 | A1 * | 10/2015 | Berdelle-Hilge | B07C 1/025 414/416.04 |

* cited by examiner

POSTAL SORTING EQUIPMENT INCLUDING A FEED MAGAZINE WITH TWO SUPERPOSED DECKS

CROSS REFERENCE TO RELATED APPLICATIONS

This application is the U.S. National Stage of International Application Number PCT/FR2014/051780 filed on Jul. 10, 2014 and claims priority under 35 USC §119 to French Patent Application No. 13 59057 filed on Sep. 20, 2013, which applications are hereby incorporated by reference in their entirety.

TECHNICAL FIELD

The invention relates to postal sorting equipment comprising a sorting machine in which mailpieces of the letter or other flat postal article type are sorted in one or more sorting passes, e.g. such as when preparing a delivery round or "postman's walk".

In a sorting process that takes place in a plurality of sorting passes, the mailpieces sorted in the sorting outlets of the machine in a first sorting pass are then transported in storage trays to the feed inlet of the machine for another sorting pass.

PRIOR ART

Currently, for preparing a delivery round, the mailpieces may, for example, be sorted in a sorting machine in two sorting passes.

At the end of the first sorting pass, the sorted mailpieces are retrieved in stacks and on edge in storage trays of the conventional box type that have four sides and that are open-topped. The storage trays as loaded with mailpieces are stored in a precise order on transit shelves of the cart type.

The unstacking operator then moves the carts as loaded with trays to the feed inlet of the sorting machine.

In general, the feed inlet of the sorting machine is provided with an unstacking member having a storage deck on which the mailpieces are placed in a stack and on edge.

The deck of the feed magazine may include a conveyor belt or a plurality of parallel conveyor belts for moving the mailpieces automatically in a stack and on edge to the unstacking member.

For loading the feed magazine, the unstacking operator takes the trays as filled with mailpieces one-by-one and places each tray at one end of the magazine, takes the mailpieces from the tray in handfuls, and places them on the deck of the feed magazine.

Retaining paddles mounted to move along the magazine for the purposes of retaining the mailpieces in a stack on the deck of the magazine may be used to assist the operator while said operator is removing the tray that has been emptied of its mailpieces and is placing it on a cart that is then brought to the sorting outlets so that the tray can be used again.

In the magazine, the mailpieces placed on the deck are thus conveyed in a stack and on edge by the conveyor belt(s), e.g. to an unstacking member that puts the mailpieces in series for the purposes of doing the second sorting pass.

The mailpieces directed towards the sorting outlets are thus stored in storage trays once again.

The trays loaded with mailpieces are then moved by the unstacking operator, e.g. to a removal zone so that one or more delivery persons can retrieve the sorted mailpieces and do their delivery rounds.

Devices exist for facilitating manual unloading of the mailpieces contained in the storage trays onto the deck of the feed magazine.

In particular, Document U.S. Pat. No. 8,172,498 describes a device comprising a tray support mounted to pivot about a first axis and capable of tilting the storage tray stored on it. Retaining means of the clamp type are also mounted to pivot about a second axis, and they are capable of retaining the mailpieces contained in the tray so as to keep them in a stack.

The device further comprises synchronization means for synchronizing the pivoting of the tray support about the first axis with the pivoting of the retaining means, in such a manner that, when the storage tray is tilted so that it can be removed by an unstacking operator, the retaining means retain the stack of mailpieces so that that stack can then be placed on the deck.

With such devices, the task of the unstacking operator is thus basically to remove the tilted tray from the tray support with the operator's arms being at full stretch.

Generally, most of the operations of moving storage trays or carts are performed by an operator entirely manually.

Unfortunately, in particular when they are loaded with mailpieces, carts and storage trays represent considerable weights to be moved by the operator, giving rise to high levels of fatigue and to health risks.

In addition, the accumulation of carts necessary for performing the machine sorting takes up a non-negligible amount of space in the vicinity of the sorting machine. There is also a risk that the trays might be swapped over during the temporary storage on the cart, giving rise to malfunctioning in the preparation of the delivery round.

In addition, at the end of the sorting passes, the unstacking operator brings the storage trays manually one-by-one or on carts to a removal zone remote from the sorting machine, and that operation is a further source of fatigue.

SUMMARY OF THE INVENTION

An object of the present invention is to remedy the above-mentioned drawbacks by proposing postal sorting equipment that minimizes the tray-handling operations, that reduces the time taken to unload the trays into the feed magazine at the inlet of the sorting machine, and that thus also reduces the risks of trays being swapped over between two sorting passes.

To this end, the invention provides postal sorting equipment comprising a sorting machine with an unstacking member and a feed magazine in which mailpieces are placed in a stack and on edge for unstacking by the unstacking member, the equipment further comprising storage trays for storing mailpieces and for bringing them into the feed magazine;

said postal sorting equipment being characterized in that the feed magazine has a deck with a first deck portion and a second deck portion, the first deck portion extending in a such a manner as to be superposed above the second deck portion;

in that each tray has a bottom shaped to define a groove that is open to the front and to the top of the tray and on which the mailpieces in a stack and on edge stand; and in that the first deck portion is configured to fit into the groove in the tray via the front so that when said tray filled with mailpieces in a stack and on edge is standing on the second deck portion, the mailpieces stand on said first deck portion.

The idea on which the invention is based is thus to use storage trays having bottoms that are open and grooved so that they are shaped like a deck of a goods transport pallet with one or more openings under the pallet deck to for receiving the prongs of a front-loading fork.

The second deck of the magazine is thus offset heightwise from the first deck of the magazine, and the first deck of the magazine acts as a loading fork.

The first deck of the magazine thus has a free end that is superposed above the second deck of the magazine so that when a tray filled with mailpieces in a stack and on edge is moved on the second deck towards the unstacking member, the first deck portion then fits into the groove(s) of the tray under the stack of mailpieces.

Said stack of mailpieces may then be taken from the tray by relative movement between the first deck portion and the second deck portion of the feed magazine.

The invention thus makes it possible automatically and simply to remove mailpieces from a storage tray into the feed magazine of a postal sorting machine while also keeping the mailpieces on edge and in a stack on the deck of the magazine.

The postal sorting equipment of the invention may advantageously have the following features:

- the second deck portion is mounted to move vertically relative to the first deck portion and in particular it moves down vertically relative to the first deck portion;
- the second deck portion is mounted to pivot about an axis, and each storage tray has a sloping bottom, thereby improving unloading of the mailpieces in a stack and on edge onto the storage deck of the magazine;
- it further comprises tray-moving means for moving the trays from the second deck portion towards a tray conveyor, it being possible for said tray-moving means to be of the belt conveyor type or of the roller conveyor type, for example;
- the first deck portion may advantageously be provided with a conveyor belt for moving the mailpieces in a stack and on edge towards the unstacking member;
- the first deck portion may be in the form of a fork having a plurality of parallel prongs, and each tray may then be provided with a plurality of corresponding parallel grooves into which the prongs of the first deck portion are engaged;
- it is then possible to provide one or each prong of the fork with a conveyor belt; and
- the magazine may be provided with a system having two movably mounted stack-retaining paddles for retaining the mailpieces that are stored on the first deck portion in a stack and on edge.

The invention also provides a method of loading a feed magazine for feeding mailpieces to a postal sorting machine, the loading taking place with a storage tray filled with mailpieces in a stack and on edge, said method being characterized in that it comprises a step of inserting a first deck portion of the magazine into the front of the storage tray, said first deck portion being superposed above a second deck portion of the magazine, on which portion the tray stands, said mailpieces then standing on edge on the first deck portion.

The method of the invention may advantageously also have the following features:

- it further comprises a step of lowering the second deck portion relative to the first deck portion for removing the tray from the feed magazine;
- it further comprises a step of pivoting the second deck portion of the magazine; and
- it further comprises a step of moving stack-retaining paddles during the lowering and pivoting movement of the second deck portion so as to maintain the mailpieces in a stack and on edge on the first deck portion.

BRIEF DESCRIPTION OF THE DRAWINGS

The present invention can be better understood and other advantages appear on reading the following detailed description of embodiments given by way of non-limiting example and with reference to the accompanying drawings, in which.

DESCRIPTION OF EMBODIMENTS

Figure 1:
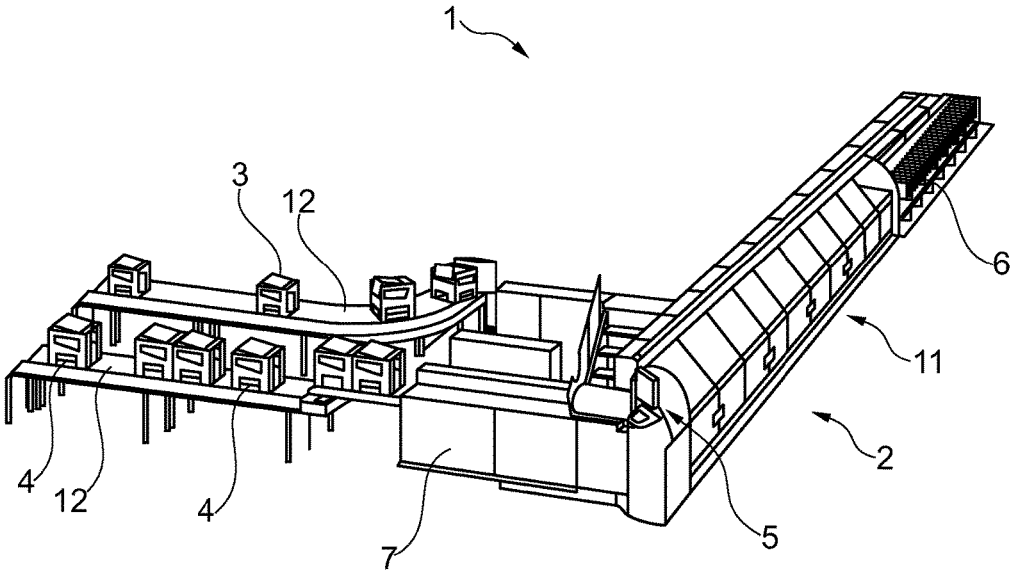
FIG. 1 is a fragmentary diagrammatic perspective view of the postal sorting equipment in an embodiment of the invention.
Figure 2:
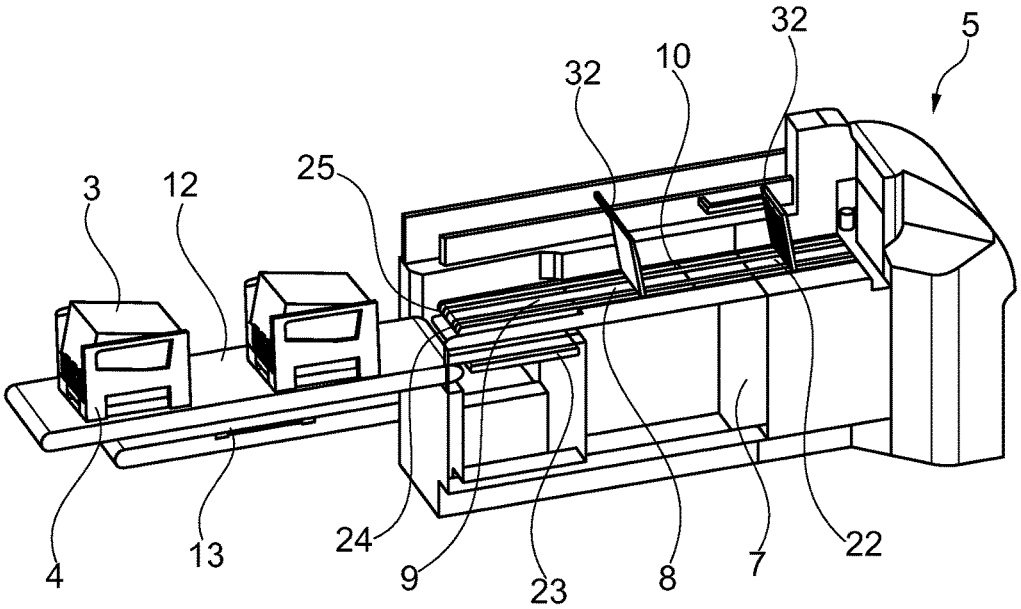
FIGS. 2 to 10 are fragmentary diagrammatic perspective views of the unstacking device with storage trays loaded with mailpieces in an embodiment of the invention.
Figure 3:
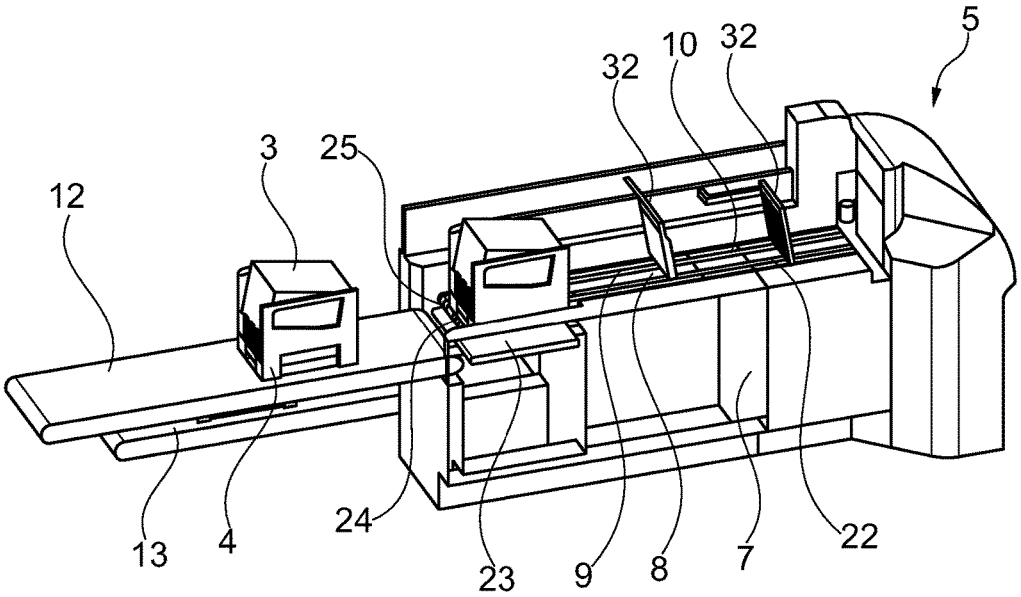
Figure 4:
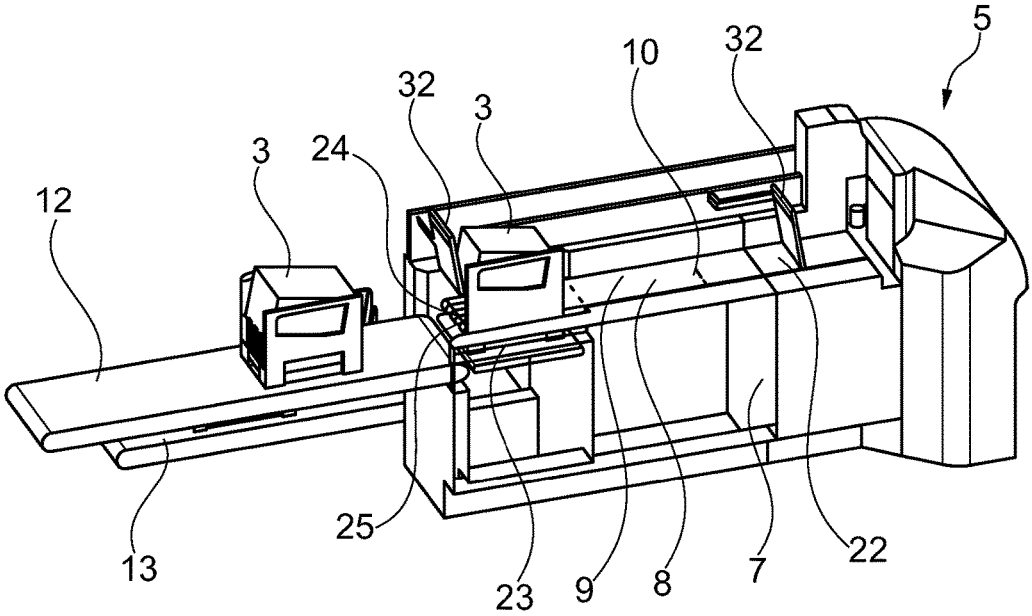
Figure 5:
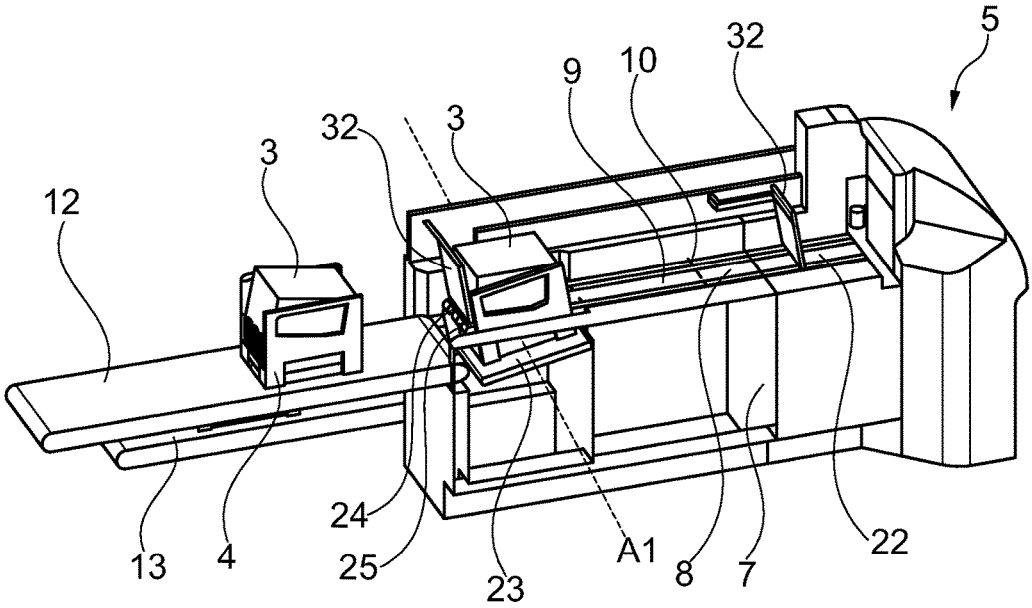
Figure 6:
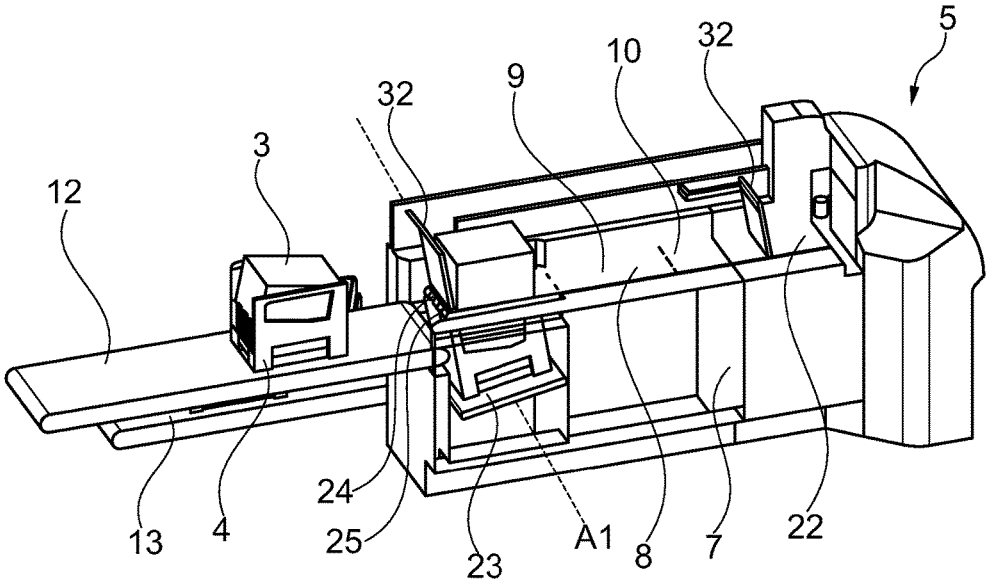
Figure 7:
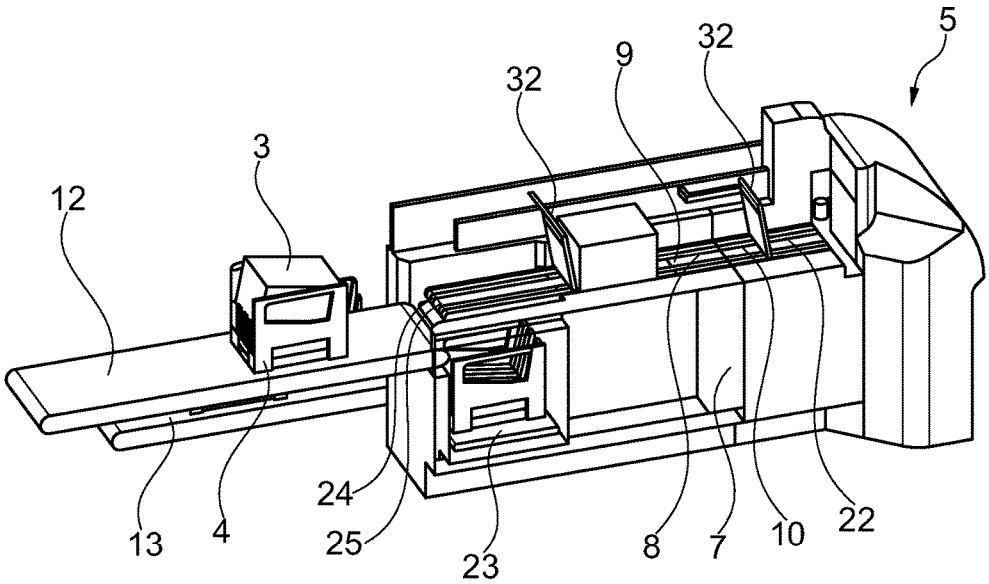

FIG. 1 shows, in fragmentary manner, postal equipment 1 of the invention comprising a sorting machine 2 for sorting mailpieces 3 in a plurality of sorting passes. For example, the postal equipment of the invention is designed to be used in postal sorting centers for preparing delivery rounds or "postman's walks". The postal sorting equipment further comprises storage trays 4 for storing the mailpieces 3. The trays, as loaded with mailpieces or as empty, are moved between various compartments of the sorting machine. The sorting machine 2 comprises an unstacking member 5, e.g. of the perforated belt and suction type, sorting outlets 6, and a feed magazine 7 for feeding in mailpieces 3, the feed magazine having a storage deck 8, as shown in FIGS. 2 to 10. This deck is designed to receive trays 4 in which mailpieces 3 are stocked in stacks and on edge.

The deck 8 may be provided with one or more parallel conveyor belts 9 for acting once the tray 4 has been removed from the magazine to move the mailpieces 3 in a stack and on edge towards the unstacking member, as shown in FIGS. 2 to 10. Two adjacent conveyor belts 9 are separated by plane and smooth surfaces 10 so that the deck has a surface that is substantially plane.

The unstacking member 5 puts the mailpieces 3 stored in the feed magazine 7 in series, and the series of mailpieces are conveyed by a sorting conveyor 11 that directs them towards the sorting outlets 6 of the machine.

The postal sorting equipment 1 shown in FIG. 1 further comprises a first tray conveyor 12 for conveying trays 4, which conveyor is designed to convey the trays loaded with mailpieces 3 from the sorting outlets 6 to the feed magazine 7 at the inlet of the machine.

A second tray conveyor 13 for conveying trays 4, which conveyor is shown in fragmentary manner in FIGS. 2 to 10, may also be added to the postal sorting equipment 1 in order to convey the empty trays from the feed magazine to the sorting outlets 6 of the machine.

The first and second tray conveyors 12 and 13 may be of the belt conveyor type with a gripping flat surface. The conveyors 12 and 13 may also be of the roller conveyor type or of some analogous type without going beyond the ambit of the invention.

In accordance with the invention, in order to allow mailpieces to be transferred automatically from a tray to the deck 8 of the feed magazine, provision is made for the deck 8 to be made up of a first deck portion 22 and of a second deck portion 23 with the first deck portion having a free end that is superposed above the second deck portion 23.

The two deck portions 22 and 23 are thus superposed and offset heightwise by a few centimeters.

FIGS. 2 to 10 show a first deck portion 22 that is in the form of a lifting fork having a plurality of parallel prongs 25. In this example, each prong of the fork is provided with a conveyor belt.

The second deck portion 23 is mounted to move vertically relative to the first deck portion 22 so as to be moved between a first position in which it is slightly below the first deck portion and a second position that is lower than the first position.

The second deck portion may also be mounted to pivot about an axis A1 in such a manner as to tilt while it is being moved between the first and second positions.

The lowering and pivoting movements of the second deck portion 23 may be obtained by means of motors that are controlled to move the second deck portion at a predefined speed.

Figure 8:
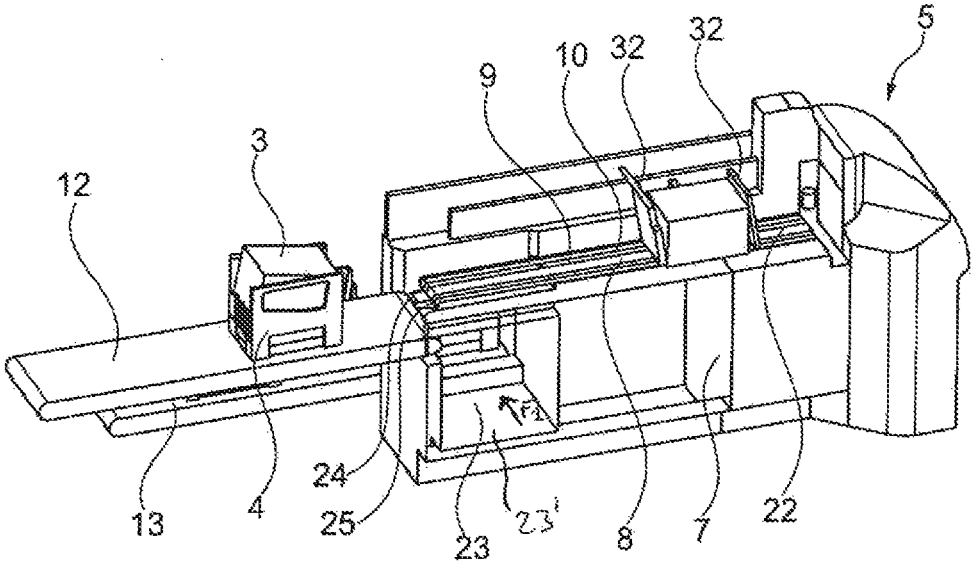
Figure 9:
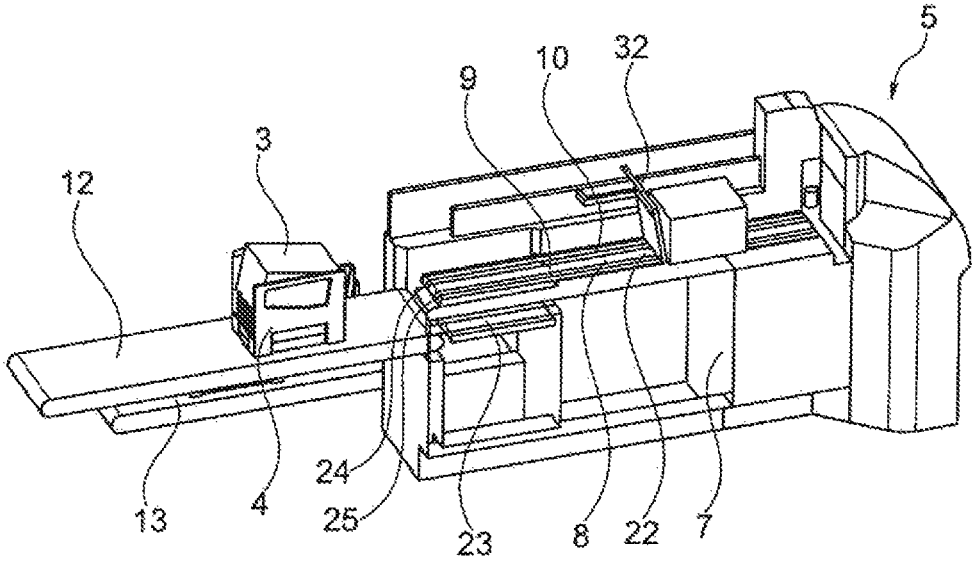
Figure 10:
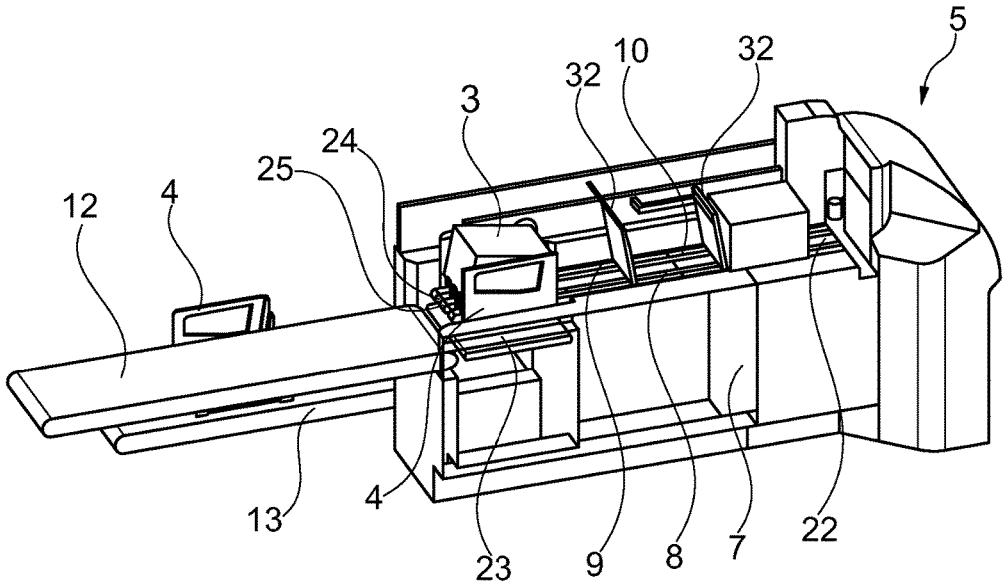

The second deck portion 23 may be provided with a tray-moving conveyor that makes it possible to move a storage tray towards the unstacking member when said second deck portion is in the first position, i.e. in the feed direction in which the unstacking member is fed with mailpieces that is not shown in the figures, and also a tray-moving conveyor 23', shown in FIG. 8 that makes it possible to move a storage tray towards the second tray conveyor 13, in the direction of the arrow F1, i.e. perpendicularly to said feed direction, when said second deck portion is in the second position.

These tray-moving means 23' may comprise a conveyor belt or any other means of imparting movement, e.g. by thrust, magnetic, or sliding drive.

Figure 11:
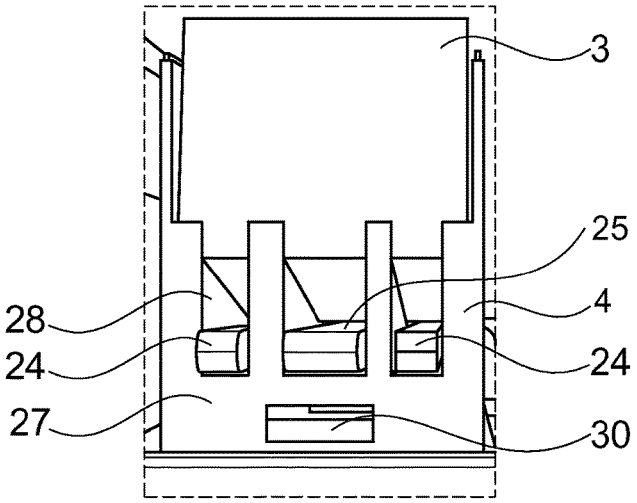
FIG. 11 is a diagrammatic side view of an edge of the storage tray loaded with mailpieces in an embodiment of the invention.
Figure 12:
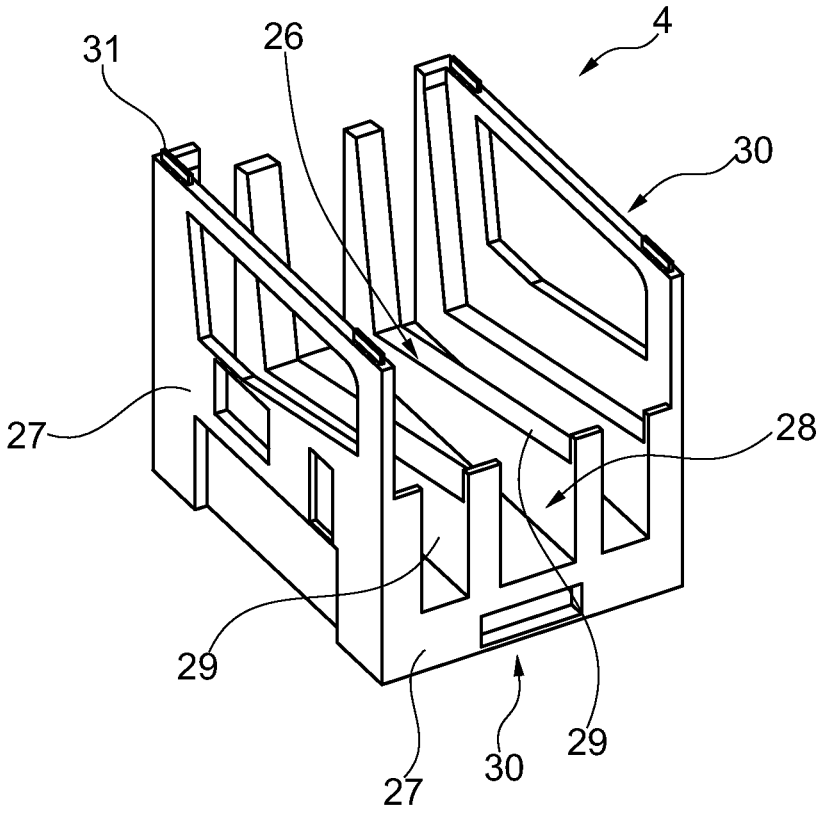
FIG. 12 is a diagrammatic perspective view of the storage tray in an embodiment of the invention.

As shown in FIGS. 11 and 12, each storage tray 4 of the invention is an open box that is normally open-topped to enable mailpieces 3 to be loaded on edge and in a stack from above the tray.

Each storage tray 4 of the invention has a substantially rectangular bottom 26 and edges 27 or sides that are substantially perpendicular relative to the bottom of the tray.

The bottom 26 of the storage tray is a little like the deck of a goods transport pallet with openings under the deck of the pallet.

In particular, the bottom of the tray is provided with one or more grooves 28 that are open to the top of the tray and to one side of the tray, which grooves form one or more openings into which the prong(s) of the first deck portion 22 can fit. The mailpieces 3 are thus stored on edge on the tops of the grooves 28 constituting the bottom 26 of the tray 4, and transversely to said grooves 28 of the tray, so that said mailpieces are raised relative to the lower base of the tray.

The prong(s) 24, 25 of the first deck portion of the magazine are thus adapted to fit into the groove(s) 28 in the tray like the prongs of the fork of a forklift or pallet truck into the openings in a transport pallet.

The prong(s) of the first deck portion 22 fit(s) into the groove(s) 28 of a tray when the base of the tray is standing on the second deck portion, the first portion of the zone fitting progressively into the groove(s) in the tray as the tray is moved in the feed direction on the second deck portion 23.

The tray may be caused to advance on the second deck portion as indicated above by a conveyor belt or the like.

The grooves 28 in the bottom of the tray extend in the feed direction when the tray is standing on the second deck portion. Each groove has a front opening on the side of the tray that faces the unstacking member.

The first deck portion comes to fit into the groove(s) in the tray 4 under the lower edges of the mailpieces 3 stored in the tray.

In order to unload the mailpieces from the tray, the second deck portion is lowered while the first deck portion retains the mailpieces heightwise. Once the tray is fully lowered, the conveyor belts 9 of the first deck portion 22 are actuated to move the mailpieces on edge and in a stack towards the unstacking member.

In order to facilitate maintaining the mailpieces in a stack and on edge on the first deck portion, it is possible to provide trays 4 that have sloping bottoms, as can be seen in FIGS. 11 and 12. In these figures, it can be seen that a central groove 28 is flanked by two ramps 29 that define the bottom of the tray, on which bottom the mailpieces stand. In this example, the tray is provided with three parallel grooves 28 across which the mailpieces are placed transversely. In this situation, the deck portion 22 may be provided with three parallel prongs adapted to fit into the three grooves in the storage trays 4.

In these figures, in particular in FIG. 12, the grooves 28 are through grooves, opening out not only to the front of the tray but also to the back of the tray, so that the prongs of the first deck portion can pass through the tray 4 entirely so as to take better hold of all of the mailpieces stored in the tray.

The back of the tray is provided with parallel slots, thereby enabling the prongs 24, 25 to be removed from the tray by lowering and pivoting the tray, while the front of the tray is almost fully open.

As can be seen, the bottom of the tray slopes downwards towards the back of the tray, which back is provided with the slots, so that, after the tray has been lowered onto the second deck portion, the stack of mailpieces is, as it were, combed and carried by the first deck portion, and said stack of mailpieces facing the unstacking member is sloping in such a manner as to be leaning towards the back of the stack. The slope of the bottom of the back may be about 10°.

It can be understood that the unstacking operator, with two stack-retaining paddles 32 hinged and movable along the first deck portion 22 in the feed direction can thus store, at the same time, two stacks of mailpieces on the deck 8, and then merge them into a single stack that comes to bear against the unstacking member as is known.

The trays 4 are preferably designed to be stackable and to include handles 30 on opposite sides 27 for handling them when they are empty, and handle-forming recesses 30 at the base of the tray in the front and in the back of the tray for handling the tray when it is loaded with mailpieces.

FIG. 12 shows lugs 31 in the top corners of the tray that serve to keep another tray stacked above it aligned and settled.

The trays 4 of the invention are, in particular, trays made of a plastics material and shaped by molding.

With the postal sorting equipment 1 of the invention, handling by the unstacking operator is limited during the successive sorting passes to handling the paddles 32 for retaining the stack of mailpieces on the deck 8 of the feed magazine.

Such sorting equipment with this type of tray and this type of feed magazine can be well adapted to sorting large-format postal articles or to sorting mixtures of small and large format postal articles.

Naturally, the present invention is in no way limited to the above description of one of its embodiments, which can undergo modifications without going beyond the ambit of the invention.

The invention claimed is:

1. A postal sorting equipment comprising a sorting machine with an unstacking member and a feed magazine in which mailpieces are placed in a stack and on edge for unstacking by the unstacking member, the equipment further comprising storage trays for storing mailpieces and for bringing them into the feed magazine;

wherein the feed magazine has a deck with a first deck portion and a second deck portion, the first deck portion extending in a such a manner as to be superposed above the second deck portion, wherein each storage tray comprises a bottom side sloped downward toward a front side of the storage tray, so that the mailpieces are stacked inclined against the bottom side and the front side of the storage tray when they are brought into the feed magazine, wherein said storage tray comprises a groove arranged in the bottom side and opened to a top of the storage tray and to the front side of the storage tray, wherein the first deck portion is configured to fit into said groove of the storage tray by said front side and under the bottom side on which the mailpieces are stacked inclined while the storage tray is carried by said second deck portion, wherein the second deck portion is mounted to pivot about an axis downwardly of the first deck portion for tilting said storage tray fitted into said first deck portion, said tilting of the storage tray being configured to comb said mailpieces by said first deck portion and to flatten on edge said stack of mailpieces on said first deck portion, and wherein said second deck portion is further mounted to move vertically below the first deck portion on which mailpieces are stacked for moving the storage tray empty of said mailpieces toward a storage tray conveyor arranged lower than the first deck portion.

2. The postal sorting equipment according to claim 1, characterized in that it further comprises tray-moving means for moving the storage trays from the second deck portion towards said storage tray conveyor.

3. The postal sorting equipment according to claim 1, characterized in that the first deck portion of the magazine is provided with a conveyor belt for moving the mailpieces in a stack and on edge towards the unstacking member.

4. The postal sorting equipment according to claim 1, characterized in that the first deck portion is in the form of a fork having a plurality of parallel prongs, and each storage tray is provided with a plurality of corresponding parallel grooves into which the prongs of the first deck portion are engaged.

5. The postal sorting equipment according to claim 1, characterized in that the magazine is provided with a system having two movably mounted stack-retaining paddles for retaining the mailpieces in a stack and on edge on the first deck portion.

* * * * *